United States Patent [19]

Esposito

[11] Patent Number: 5,041,720

[45] Date of Patent: Aug. 20, 1991

[54] STOVE-TOP SAFETY GRATE FOR ELECTRIC STOVES

[76] Inventor: Frank Esposito, 83-15 Thirteenth Ave., Apt. 1, Brooklyn, N.Y. 11228

[21] Appl. No.: 550,411

[22] Filed: Jul. 10, 1990

[51] Int. Cl.[5] ..... H05B 3/68

[52] U.S. Cl. ..... 219/443; 126/214 C

[58] Field of Search ..... 219/443, 429, 430, 439; 126/211, 214 C, 214 D, 214 R

[56] References Cited

U.S. PATENT DOCUMENTS

| | | | |
|---|---|---|---|
| 897,928 | 9/1908 | Reiter | 126/214 C |
| 1,196,602 | 8/1916 | Smith . | |
| 1,678,269 | 7/1928 | Pickup . | |
| 1,922,420 | 8/1953 | Coulston . | |
| 2,565,726 | 8/1951 | Garrison . | |
| 2,861,563 | 11/1958 | Jensen . | |
| 3,187,742 | 6/1965 | Powers | 126/214 C |
| 3,583,384 | 6/1971 | Ranisate . | |
| 4,059,092 | 11/1977 | Bourboulis | 126/215 |
| 4,126,120 | 11/1978 | Bourboulis . | |
| 4,448,186 | 5/1984 | Smith | 126/215 |

*Primary Examiner*—Teresa J. Walberg

*Attorney, Agent, or Firm*—Morgan & Finnegan

[57] ABSTRACT

A heat deflector is disclosed for use on electric stove heating elements. The deflector includes a heat shield and a support/spacer member to support the cooking utensil in a level position in relation to the electric heating element. The shield serves to block heat rising from the electric coil and prevent overheating of the cooking utensil handle. The invention is suitable for use on virtually all electric stoves regardless of the size or shape of their heating elements.

10 Claims, 1 Drawing Sheet

STOVE-TOP SAFETY GRATE FOR ELECTRIC STOVES

BACKGROUND AND OBJECTS OF THE INVENTION

1. Field of the Invention

The present invention relates generally to electric stove-top burners, and, more particularly, to a heat deflector for electric heating elements that can be added to existing electric heating elements, or formed integrally with such elements, to redirect the heat emitted from the electric heating element away from the handle of the cooking utensil being heated (e.g., a pot handle) so that the handle does not become excessively hot, yet will not appreciably diminish the heating effect on the food within the utensil.

2. Description of the Prior Art

Most electric stoves have a flat top with one or more electric heating elements set in the stove top. Cooking utensils (e.g., pots, pans) are placed on the heating elements and the heat energy generated by the electric heating element is transferred primarily through the direct contact between the element and the cooking utensil (conduction) and through indirect heat transfer from the element to the handle on the cooking utensil (convection and/or radiation).

The electric stove heating elements are typically spiral or round. When a cooking utensil is placed on the electric heating element, some of the heat generated will heat the air along the side of the cooking utensil to become dangerously hot. The tendency to heat the handle becomes particularly problematic when the utensil covers a smaller area than the overall area of the heating element.

Although a smaller heating element or a larger cooking utensil could be used, neither solution is satisfactory. The use of a larger utensil tends to increase cooking time (as well as increasing clean-up duties), and could compromise the quality of the food, while use of a smaller heating element, assuming one could be made available, is very inefficient. Although use of a potholder will reduce the risks of accidental burns, it does nothing to reduce the temperature of the handle. Thus, anyone forgetting to use a potholder to grasp the handle will likely be burned.

Since there is a genuine need to prevent the heat generated by electric stoves from increasing the handle temperature, a device that is simple, reliable and inexpensive to manufacture and that assists in decreasing the heat transferred to the handle is desirable for increased kitchen safety. The device should be suitable for mounting on the heating element of existing electric stoves and for incorporation into future electric stove constructions.

Bourboulis U.S. Pat. No. 4,126,120, discloses a device used to distribute heat evenly over the bottom of the cooking utensil. The apparatus could be used on any stove top, not just electric stoves. However, the Bourboulis patent does not teach or suggest the restriction of the heat flowing toward the utensil handle.

It is believed that there is no available device to prevent overheating of a pot handle by the heating element on electric stoves while giving little or no interference to the transfer of heat to the contents of the pot.

OBJECTS OF THE INVENTION

It is therefore an object of the present invention to provide a heat deflector for electric stoves which prevents cooking utensil handles from growing excessively hot.

Another object of the invention is to provide a heat deflector for electric stoves that is relatively inexpensive to manufacture and can easily be mounted on pre-existing electric stove coils of provided as part of the original equipment.

A further objective of the present invention is to provide a heat deflector that the cook can easily use and readily determine where the cooking utensil's handle should be located for minimal heating of the handle.

Objects and advantages of the invention are set forth in part herein and in part will be obvious here from, or may be learned by practice with the invention, the same being realized and attained by means of the instrumentalities and combinations pointed out in the appended claims. The invention thus consists in the novel parts, constructions, arrangements, combinations, steps and improvements herein shown and described.

It will be understood that the foregoing general description and the following detailed description as well are exemplary and explanatory of the invention but are not restrictive thereof. The accompanying drawings, referred to herein and constituting a part hereof, illustrate preferred embodiments of the invention, and together with the description, serve to explain the principles of the invention.

SUMMARY OF THE INVENTION

Briefly, the invention includes a heat shield member proportioned to overlie a portion of the heating element of an electric stove and a support/spacer member to provide a level surface for supporting the cooking utensil. The heat shield preferably is made from a solid piece of sheet metal or like material which will permit transfer of heat to the utensil by conduction but generally blocks convective transfer of heat to a utensil handle positioned over the heat shield so that the handle will not overheat.

The simplicity of the present invention allows it to be simply and reliably mounted on existing electric stove configurations. The device deflects the heat away from the cooking utensil handle thereby limiting the increase in the handle's temperature. The device can be made of any materials that do not soften or melt at very high temperatures and that tend to conduct heat more readily than radiate it.

Advantageously, when the upper deflector plate is made from a solid sheet, tabs may be provided on the deflector to help secure the support/spacer to the device. The tabs should slide into contact with the side surface of a segment of the electric coil to secure the assembly against horizontal movement.

Persons using the invention can readily determine where on the electric coil they should put a cooking utensil's handle simply by looking at the electric coil surface where the invention is installed. The "safe zone", where the handle is protected, lies directly above the deflector plate. Thus, for the handle to stay sufficiently cool to allow hand contact by users, it need only be positioned over the heat shield member.

The shield is preferably located on the side of each coil rather than the front edge. For example, in the usual four-coil electric stove, the heat shield for each coil on the left side (as seen by someone looking down from the front of the stove) is installed preferably at about the "9 o'clock" position and those on the right hand side are at about the "3 o'clock" position. This positioning is of particular benefit when children are in the household who might accidentally grab the handle of a hot pot if the handle is hanging over the front edge of the stove.

Unlike gas or other flame driven stoves, there is no visible flame with an electric stove. Therefore, the user does not have the benefit of observing flames that come around the side of the cooking utensil that may make the handle hot. Thus, unless one touches the handle, a user generally has no indication that the handle is hot when using an electric stove. The difference in the user's ability to detect the temperature of the cooking utensil handle makes the invention extremely useful for use on electric stoves.

Electric heating elements come in a variety of shapes and sizes. The present invention is specifically designed to be mounted on virtually any type of electric stove-top coil regardless of size or shape. It is inexpensive to manufacture and provides a low cost means of reducing the amount of heat a utensil handle is exposed to in a structure that is easy to use and install, whether on existing stoves or as original equipment.

BRIEF DESCRIPTION OF THE DRAWINGS

The accompanying drawings, referred to herein and constituting a part hereof, illustrate the preferred embodiments of the electric stove deflector shield according to the present invention, and together with the detailed description hereafter serve to explain the principles of the invention.

DETAILED DESCRIPTION OF THE PREFERRED EMBODIMENTS

Because of the variability of electric stove heating element sizes, the present invention incorporates a mounting design that is sufficiently flexible to allow the invention to be attached to virtually any type of electric stove. The embodiments disclosed herein include the basic structure of the heat deflector invention for electric stoves—namely a flat, heat shield member and support/spacer means for cooperating with the heat shield member to support the cooking utensil in a level position in conjunction with the heat shield. It will thus be understood that the depiction of heating element 14 (identified hereafter) is for illustration only and is not intended to represent a particular configuration.

Figure 1:
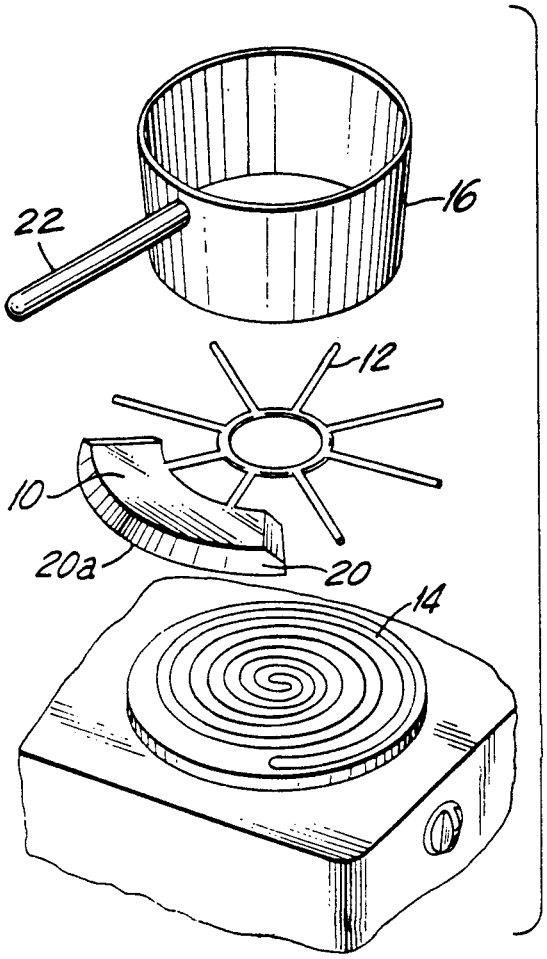
FIG. 1 is a perspective, exploded, view showing one embodiment of the present invention in relation to a stove's electric coil and a cooking utensil.
Figure 2:
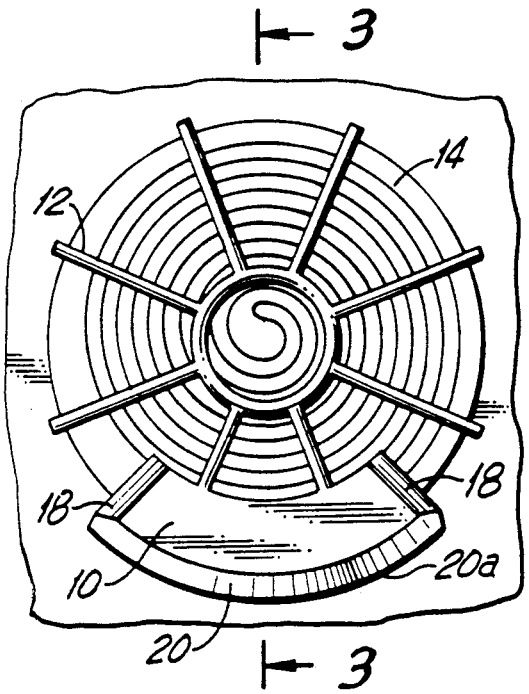
FIG. 2 is a top plan view of the embodiment depicted in FIG. 1, which also illustrates mounting the invention on an electric heating element.
Figure 3:
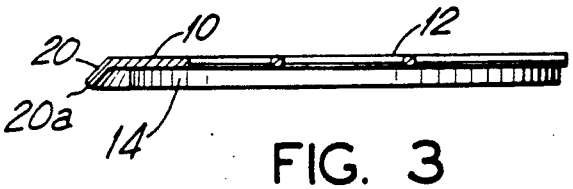
FIG. 3 is a cross-sectional view along 3—3 in FIG. 2.

Referring now to the drawings, and in particular to FIGS. 1-3, there is depicted one embodiment of the pre'sent invention, comprising two basic parts, heat shield 10 and support/spacer member 12. As here embodied, heat shield 10 has the general shape of a truncated sector of a circle. Preferably, shield 10 covers only so much of an electric heating element (indicated generally at 14) as to provide an effective heat shield to prevent handle 22 of a cooking utensil (here, pot 16) from being overheated by the heat generated by the electric coil yet provide for the heat to be conducted to utensil 16 with little or no reduction in heating efficiency. To this end, shield 10 may cover about 10% to about 20% of the area of the outermost portion of the heating element.

Support member 12 is attached to or otherwise forms part of shield 10 both to help shield 10 remain in place on the heating element and to provide a substantially level, stable surface to support a pot, pan or other cooking utensil. To this end, advantageously and as preferably embodied, the upper support surface provided by support member 12 is essentially co-planar with the top surface of shield 10. As embodied in FIGS. 1-3, support member 12 may be formed integrally with shield 10 such that they are of essentially the same thickness and will thereby satisfy the two foregoing goals. Also as embodied in FIGS. 1-3, support member 12 is generally made up of a wire-like structure (here in a "star-burst" configuration) to ensure that the support member does not impede the transfer of heat from the heating element to the cooking utensil yet provides adequate support for virtually any size cooking utensil.

Shield 10 may also include two side-edge lips 18 which extend downwardly from shield 10 by a distance such that lips 18 tend to limit the amount of heat rising around the sides of shield 10. A back-edge lip, 20, preferably proportioned generally to rest upon the stove top while the shield 10 is installed on the burner 14, may be formed along the back edge of shield 10 to ensure heat does not escape around the back edge of shield 10. Taken together, the lip 20 on the back side and the two side-edge lips 18 on the lateral sides further help prevent heat from rising up to heat the handle.

As shown in FIGS. 1-3, edge lips 18 and 20 are preferably formed integrally with, and bent downwardly from shield 10. Shield 10 and edge lips 18 and 20 are dimensioned so that when the shield 10 is placed atop electric coil heating element 14, shield 10 generally covers an ample "safe zone" to protect cooking utensil handle 22 from being overheated. Back-side edge lip 20 also helps to restrain the invention from sliding inwardly over electric heating element 14 and also helps to control lateral movement.

FIG. 1 also illustrates a particularly useful advantage of the present invention. As preferably embodied, similar to that described in my co-pending applications Ser. Nos. 07/394,580 (filed Aug. 6, 1989) now U.S. Pat. No. 4,942,864 and 07/505,038 (filed Apr. 5, 1990), the disclosures of which are hereby incorporated by reference. Shield 10 and spacer 12, according to the invention, are mounted on the stove in such a way as to provide an unmistakable guide to avoid having cooking utensil handle 22 hang over the front of the stove (dial 24 being on the front of the stove in FIG. 1).

Here, shield 10 is placed at a 9 o'clock position on left-front electric heating element 14 shown in FIG. 1. A user will thus be guided to orient cooking utensil 16 so that handle 22 is positioned directly over shield 10. In this way, pot handle 22 will not hang over the front edge of the stove where it poses a serious risk that someone (especially a child) might pull down on the handle and be scalded by any hot contents of cooking utensil 16, or by utensil 16 itself. It will be understood that shield 10 is preferably mounted at about the 3 o'clock position on the right-side burners (not shown) of a stove.

Figure 4:
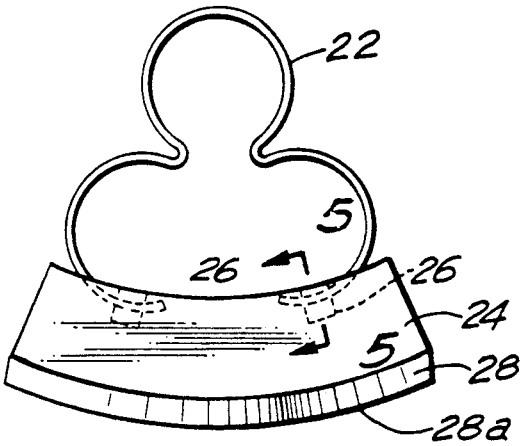
FIG. 4 is a top plan view of another embodiment of the present invention.
Figure 5:
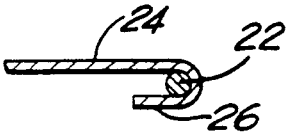
FIG. 5 is a cross-sectional view along 5—5 in FIG. 4 that depicts the connection between the deflector shield and the supporting member in that particular embodiment.

FIGS. 4–5 depict another embodiment of the present invention in top plan view and cross-section, which is a modified version of the structure depicted in FIGS. 1–3. This embodiment differs basically in the construction of spacer/support member (here indicated at 22) and shows how virtually any desired configuration can be used. As here embodied, spacer/support 22 is formed from a wire-like member, as described above, but in the configuration of a clover-leaf.

FIGS. 4–5 also provide a perspective of how the support/spacer 22 may be attached to the shield (here indicated at 24). As here embodied, shield 24 is a sheet of metal much like shield 20 described above. To secure spacer/support 22 to shield 24, the inward edge of shield 24 is formed with a pair of securing tabs 26. Tabs 26 may be bent over the ends cf spacer 22 to mechanically lock the wire assembly in place. Other attaching means are possible by any well-known technique, including welding, brazing, soldering, or other types of mechanical fastening.

Advantageously, in order to ensure a stable cooking surface, the invention is preferably proportioned such that when the support/spacer member is resting on heating element 14, the bottom edge (20*a* or 28*a*) of the back lip (20 or 28) is resting on the stove. Because most electric stove heating elements are raised above the top surface of the stove, a particularly useful configuration includes a back-edge lip having the bottom edge of its back-edge lip spaced about $\frac{3}{8}''$ to about $\frac{1}{2}''$ from the bottom surface of the shield member and the corresponding bottom edge of its side-edge lips spaced about $\frac{1}{8}''$ to about $\frac{1}{4}''$.

The invention in its broader aspects is not limited to the specific embodiments herein shown and described. Thus, those skilled in the art will appreciate that departures may be made from the disclosed embodiments which are within the scope of the accompanying claims, without departing from the principles of the invention and without sacrificing its chief advantages.

I claim:

1. A stove-top heat deflector for electrically operated stoves for preventing the handle of a cooking utensil from being overheated higher than can be tolerated by hand contact, said deflector comprising:

a generally flat heat shield member adapted to block a portion of the heat emanating from a heating element of the electrically operated stove; and a support/spacer member attached to said heat shield member to provide, in combination with said heat shield member, a generally level and stable support surface for a cooking utensil, such that when the cooking utensil is placed on said heat deflector with its handle positioned over said heat shield member, said heat shield member will substantially prevent the handle from becoming heated higher than can be tolerated for hand contact.

2. A deflector according to claim 1, wherein said heat shield member has a downwardly extending lip along its radially outer edge.

3. A deflector according to claim 2 wherein said outer edge lip is proportioned generally to abut the stove top when said deflector rests atop the electric heating element.

4. A deflector according to claim 2, which further includes a lip extending downwardly from each side edge of said heat shield.

5. A deflector according to claim 4 wherein said side edge lips are proportioned to rest against the heating element of the stove and support said heat shield member above said heating element by a height approximately equal to the thickness of said support/spacer member to help ensure a level and stable support surface is provided for the cooking utensil.

6. A deflector according to claim 5, wherein said back edge lip is proportioned generally to about the top surface of the stove.

7. A deflector according to claim 1 wherein said heat shield is formed integrally with said support/spacer member.

8. A deflector according to claim 1 wherein said support/spacer member is a wire structure.

9. A deflector according to claim 1 wherein said support/spacer member has a star-burst configuration.

10. A deflector according to claim 1, wherein said support/spacer member has a clover-leaf configuration.

* * * * *